US005401029A

United States Patent [19]

Ivancevich et al.

[11] Patent Number: 5,401,029

[45] Date of Patent: Mar. 28, 1995

[54] GOLFING AID FOR VERIFYING A PROPER GOLFING STANCE

[76] Inventors: Steven D. Ivancevich, 1225 Llewellyn Rd.; Terrill W. Carter, 1403 West Point, both of Mt. Pleasant, S.C. 29464

[21] Appl. No.: 237,867

[22] Filed: May 4, 1994

[51] Int. Cl.[6] ..... A63B 69/36

[52] U.S. Cl. ..... 273/187 R

[58] Field of Search ..... 273/187 R, 187 A, 187 B, 273/187.1, 188 R, 188 A

[56] References Cited

U.S. PATENT DOCUMENTS

| | | | |
|---|---|---|---|
| 2,457,351 | 12/1948 | Crowley | 273/187 R |
| 3,384,377 | 5/1968 | Stipp | 273/187 R |
| 3,638,950 | 2/1972 | Hyotlaine | 273/187 R |
| 4,478,422 | 10/1984 | Blanchard | 273/187 R |
| 4,647,048 | 3/1987 | Welch | 273/187 R |

*Primary Examiner*—George J. Marlo
*Attorney, Agent, or Firm*—Hugh E. Smith

[57] ABSTRACT

A golfing aid for verifying a proper golfing stance comprising a front component positionable on the ground adjacent to golf ball to be hit in contact with the toes of the golfer's shoes and positioned between the feet of the player and the ball, the front component being in a linear configuration and formed of two elongated parts axially aligned and adjustable with respect to each other for varying the length thereof, the parts including a left part with a longitudinal slot along the majority of its length and an aperture at its left end and an imperforate section at its right end with a projection therebetween, the parts including a right part with a longitudinal slot adapted to receive the projection and an aperture at its right end; a left component having an aperture at its front end and at its rear end and with an upper and lower surface; a right component having an aperture at its forward end for alignment and coupling with the aperture at the right end of the first component and with an aperture at its rearward end for coupling with the aperture at the rear end of the left component, one surface of the rearward end of the right component being recessed for coupling with a mating recess in a mating surface of the rear end left component; three coupling bolts with washers and wing nuts positionable through the aligned apertures at the ends of the components for securing them in a desired position; an adjustment bolt, wing nut and washer positionable through the slot of the first part and an aligned aperture of the second part for adjusting the length of the two parts of the first component.

3 Claims, 3 Drawing Sheets

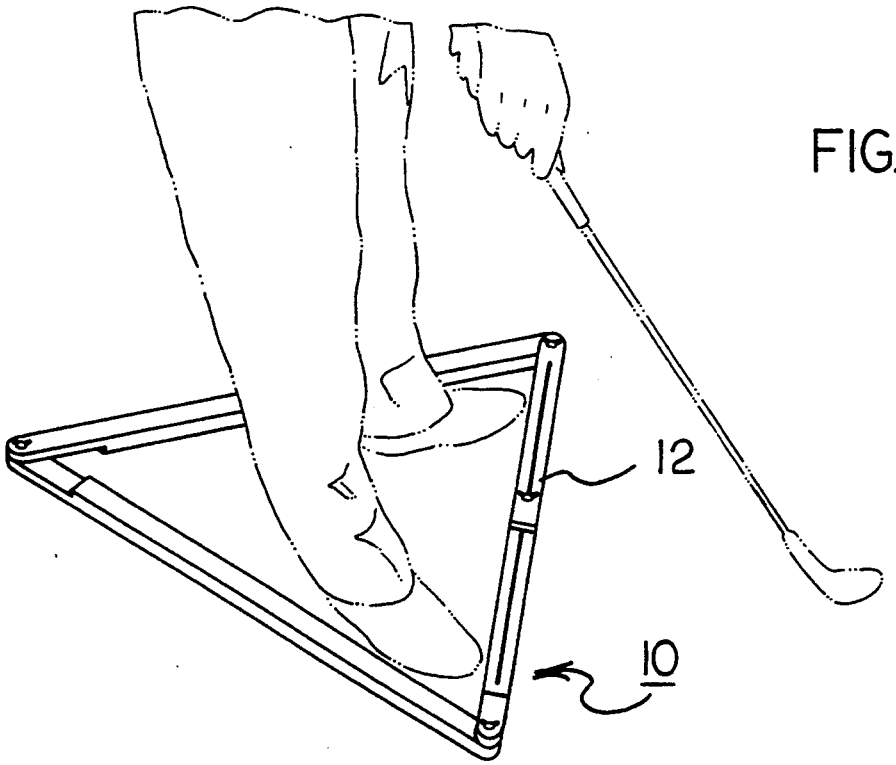
FIG. 1
FIG. 2
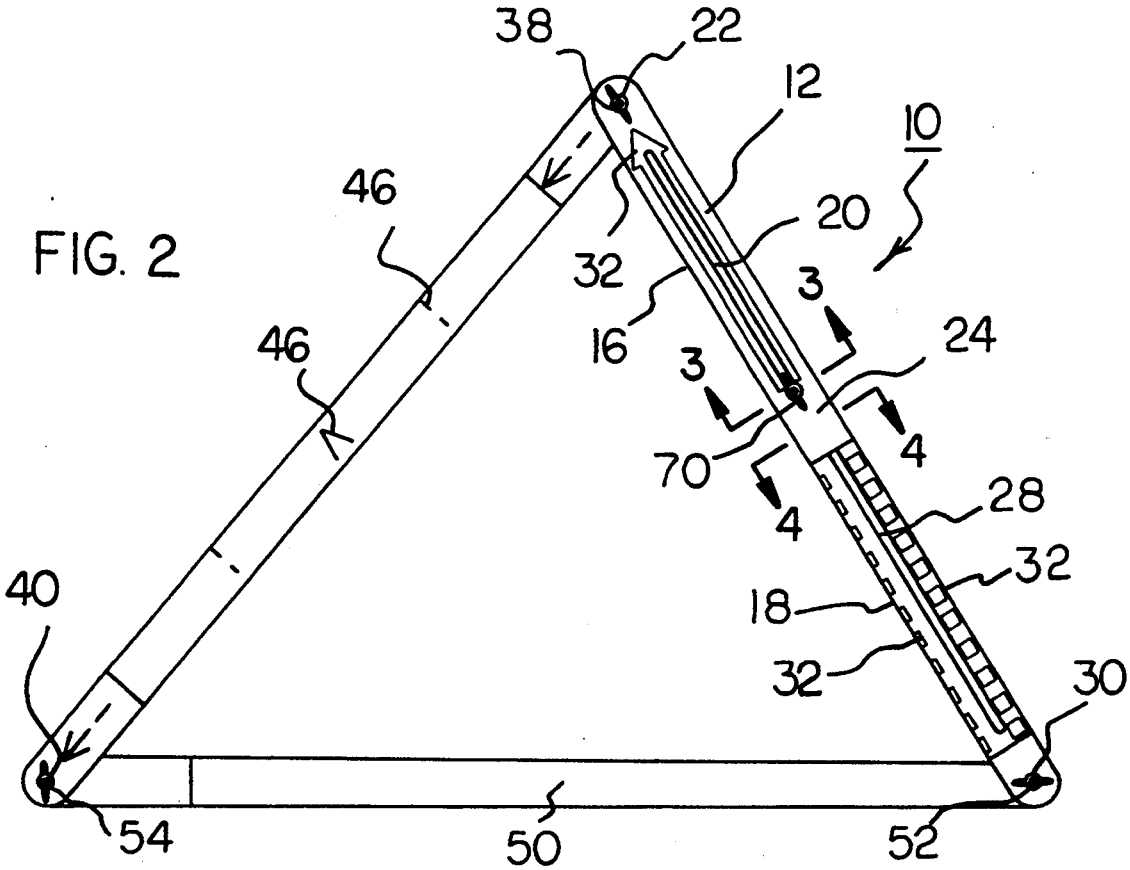

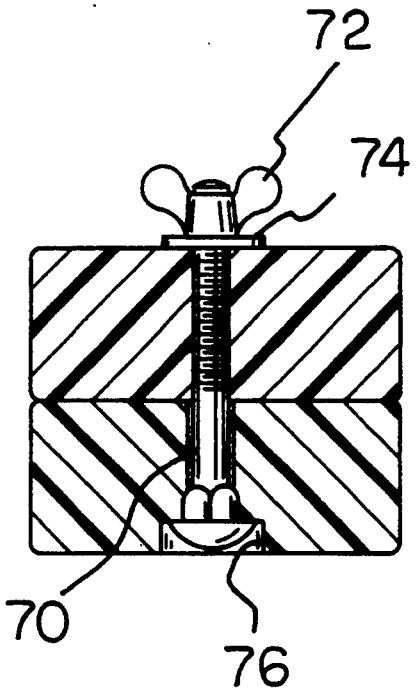
FIG. 3
FIG. 4
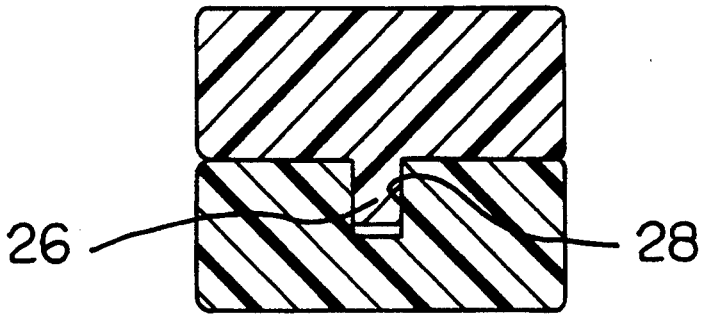

FIG. 5
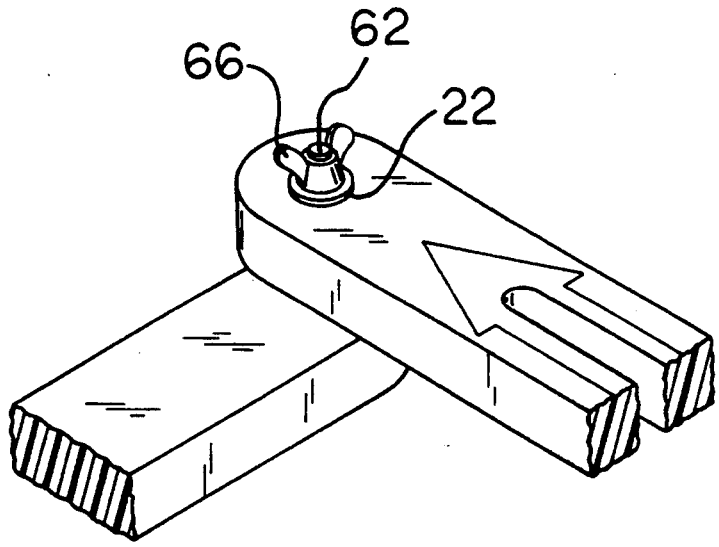
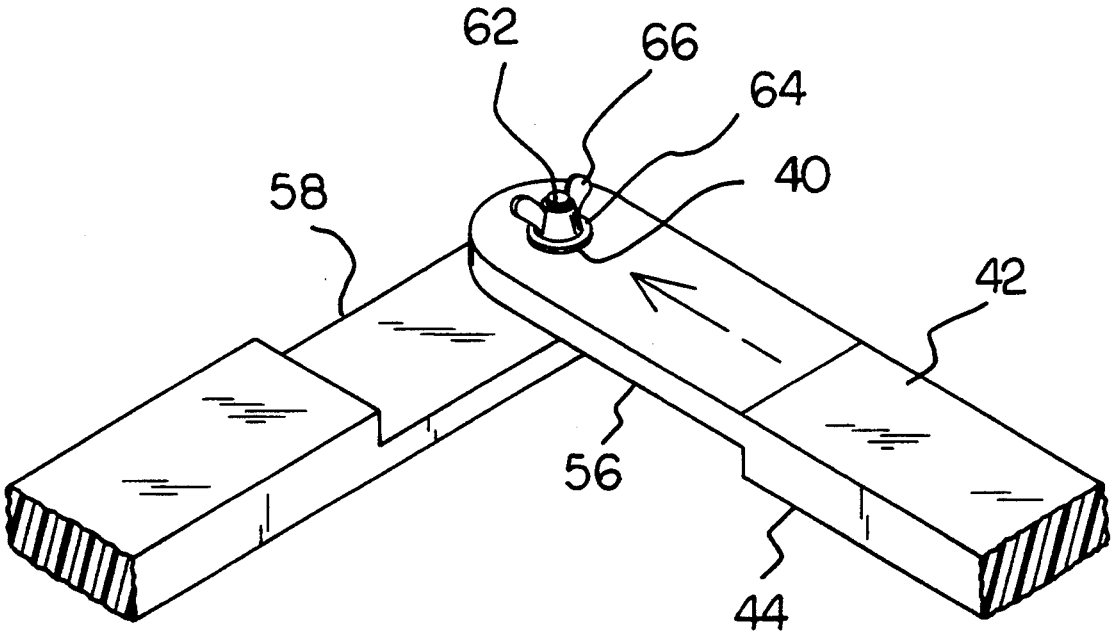
FIG. 6

GOLFING AID FOR VERIFYING A PROPER GOLFING STANCE

BACKGROUND OF THE INVENTION

1. Field of the Invention

The present invention relates to golfing aid for verifying a proper golfing stance and more particularly pertains to insuring a proper golfing stance when addressing and hitting golf balls with various clubs.

2. Description of the Prior Art

The use of golfing aids for stance improvement is known in the prior art. More specifically, golfing aids for stance improvement heretofore devised and utilized for the purpose of positioning the golfer's feet prior to hitting the ball are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,203,453 to Dirito a golf stance device.

U.S. Pat. No. 5,108,106 to Cook discloses a golf alignment template.

U.S. Pat. No. 5,110,132 to Weston et al. discloses an alignment apparatus for golfers.

U.S. Pat. No. 5,083,789 to Hickson discloses a golf stance alignment and training device.

U.S. Pat. No. 4,993,716 to Waller discloses a golf stance alignment device.

In this respect, the golfing aid for verifying a proper golfing stance according to the present invention substantially departs from the conventional concepts and designs of the prior art, and in doing so provides an apparatus primarily developed for the purpose of insuring a proper golfing stance when addressing and hitting golf balls with various clubs.

Therefore, it can be appreciated that there exists a continuing need for new and improved golfing aid for verifying a proper golfing stance which can be used for insuring a proper golfing stance when addressing and hitting golf balls with various clubs. In this regard, the present invention substantially fulfills this need.

SUMMARY OF THE INVENTION

In view of the foregoing disadvantages inherent in the known types of golfing aids for stance improvement now present in the prior art, the present invention provides an improved golfing aid for verifying a proper golfing stance. As such, the general purpose of the present invention, which will be described subsequently in greater detail, is to provide a new and improved golfing aid for verifying a proper golfing stance and method which has all the advantages of the prior art and none of the disadvantages.

To attain this, the present invention essentially comprises a new and improved golfing aid for verifying a proper golfing stance comprising, in combination, a front component positionable on the ground adjacent to golf ball to be hit in contact with the toes of the golfer's shoes and positioned between the feet of the player and the ball, the front component being in a linear configuration and formed of two elongated parts axially aligned and adjustable with respect to each other for varying the length thereof, the parts including a left part with a longitudinal slot along the majority of its length and an aperture at its left end and an imperforate section at its right end with a projection therebetween, the parts including a right part with a longitudinal slot adapted to receive the projection and an aperture at its right end, and with indicia on the upper surface of the left part and right part; a left component having an aperture at its front end and at its rear end and with an upper and lower surface with indicia on its upper surface; a right component having an aperture at its forward end for alignment and coupling with the aperture at the right end of the first component and with an aperture at its rearward end for coupling with the aperture at the rear end of the left component, the upper surface of the rearward end of the right component being recessed for coupling with a mating recess in the lower surface of the rear end left component; three coupling bolts with washers and wing nuts positionable through the aligned apertures at the ends of the components for securing them in a desired position; an adjustment bolt, wing nut and washer positionable through the slot of the first part and an aligned aperture of the second part for adjusting the length of the two parts of the first component whereby a user may place his feet within the triangle created by the components in an orientation dictated by the selection of the club and the indicia on the front and left components.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golfing aid for verifying a proper golfing stance which have all the advantages of the prior art golfing aids for stance improvements and none of the disadvantages.

It is another object of the present invention to provide a new and improved golfing aid for verifying a proper golfing stance which may be easily and efficiently manufactured and marketed.

It is further object of the present invention to provide a new and improved golfing aid for verifying a proper golfing stance which are of durable and reliable constructions.

An even further object of the present invention is to provide a new and improved golfing aid for verifying a proper golfing stance which are susceptible of a low cost of manufacture with regard to both materials and labor, and which accordingly are then susceptible of low prices of sale to the consuming public, thereby making such golfing aid for verifying a proper golfing stance economically available to the buying public.

Still yet another object of the present invention is to provide a new and improved golfing aid for verifying a proper golfing stance which provide in the apparatuses and methods of the prior art some of the advantages thereof, while simultaneously overcoming some of the disadvantages normally associated therewith.

Still another object of the present invention is to insure a proper golfing stance when addressing and hitting golf balls with various clubs.

Lastly, it is an object of the present invention to provide a new and improved golfing aid for verifying a proper golfing stance comprising a front component positionable on the ground adjacent to golf ball to be hit in contact with the toes of the golfer's shoes and positioned between the feet of the player and the ball, the front component being in a linear configuration and formed of two elongated parts axially aligned and adjustable with respect to each other for varying the length thereof, the parts including a left part with a longitudinal slot along the majority of its length and an aperture at its left end and an imperforate section at its right end with a projection therebetween, the parts including a right part with a longitudinal slot adapted to receive the projection and an aperture at its right end; a left component having an aperture at its front end and at its rear end and with an upper and lower surface; a right component having an aperture at its forward end for alignment and coupling with the aperture at the right end of the first component and with an aperture at its rearward end for coupling with the aperture at the rear end of the left component, one surface of the rearward end of the right component being recessed for coupling with a mating recess in a mating surface of the rear end left component; three coupling bolts with washers and wing nuts positionable through the aligned apertures at the ends of the components for securing them in a desired position; an adjustment bolt, wing nut and washer positionable through the slot of the first part and an aligned aperture of the second part for adjusting the length of the two parts of the first component.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the golfing aid for verifying a proper golfing stance constructed in accordance with the principles of the present invention.

FIG. 2 is a top elevational view of the device illustrated in FIG. 1.

FIG. 3 is a cross sectional of the device of the prior Figures taken along line 3—3 of FIG. 2.

FIG. 4 is a cross sectional view of the device of FIGS. 1 and 2 taken along line 4—4 of FIG. 2.

FIG. 5 is a perspective view of the coupling means for joining two of the pieces at the front left corner.

FIG. 6 is a perspective view showing the mechanisms for coupling the rear corner of two of the component elements.

The same reference numerals refer to the same parts through the various Figures.

DESCRIPTION OF THE PREFERRED EMBODIMENT

With reference now to the drawings, and in particular to FIG. 1 thereof, the preferred embodiment of the new and improved golfing aid for verifying a proper golfing stance embodying the principles and concepts of the present invention and generally designated by the reference numeral 10 will be described.

The present invention, golfing aid for verifying a proper golfing stance, is comprised of a plurality of component elements. In their broadest context, such component elements include a front component, a left component, a right component, bolts coupling the components, and an adjustment bolt adapted to vary the length of the front component. Such components are specifically configured and correlated with respect to each other so as to attain the desired objectives.

More specifically, the system 10 of the present invention has a front component 12. Such component is positionable on the ground adjacent to the golf ball to be hit and adjacent to the player. Such component is positioned so that the toes of the golfer's shoes are in contact with the adjacent edge of the front component. Such front component is positioned between the feet of the player and the ball to be hit.

The front component is in a linear configuration. It is formed of two elongated parts axially aligned and adjustable with respect to each other. This is for varying the length of the front component. The parts of the front component include a left part 16 and right part 18. The left part is formed with a longitudinal slot 20 along the majority of its length. It has an aperture 22 at its left end and an imperforate section 24 at the right end. A projection 26 extends beneath the left part. The parts also include a right part with a longitudinal slot 28 adapted to receive the projection of the first part. The right part also has an aperture 30 at its right end. In the preferred embodiment, indicia 32 is formed on the upper surface of the left part and right part to assist in improving the golfer's stance.

Next provided is a left component 36. The left component has an aperture 38 and 40 at its front end and its rear end. It also has an upper surface 42 and a lower surface 44. The upper surface is preferably formed with indicia 46 thereon.

The right component 50 is also formed with an aperture 52 and 54 at its forward end and its rearward end. The apertures of the left and right components as well as the front component are adapted to be aligned and coupled through the apertures at the right end of the first component with an aperture at its rearward end for coupling with the apertures of the rearward end of the left component. The upper surface of the rearward end of the right component is formed with a recess 56 for coupling with a mating recess 58 in the lower surface of the rear end of the left component.

Coupling between the various components is effected through three coupling bolts 62. Such bolts have associated washers 64 and wing nuts 66. The bolts are positionable through the aligned apertures at the end of the components for securing them in a desired position.

In addition to the coupling bolts, there is provided a single adjustment bolt 70. Such adjustment bolt has an associated wing nut 72 and washer 74. The adjustment bolt is positionable through the slot of the first part and an aligned aperture 76 of the second part. Such bolt is for adjusting and holding the length of the two parts of the first component. In this manner, a user may place his feet in the triangle created by the components in an orientation dictated by the selection of the club and the indicia on the front and left components.

The present invention is designed to instruct persons in: proper stance and alignment when addressing to hit a golf ball, through a simple numbering system. The invention can be used by right or left handed golfers; male-female; of all level skills.

The present invention is constructed of four pieces in the shape of a triangle. One side consists of two pieces joined by a simple adjusting screw. The two piece side can be adjusted to create different dimensions in the triangle to facilitate different size golfers. Light weight, can be carried in any golf bag. Easy to use, easy to adjust.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved golfing aid for verifying a proper golfing stance comprising, in combination:

a front component positionable on the ground adjacent to golf ball to be hit in contact with the toes of the golfer's shoes and positioned between the feet of the player and the ball, the front component being in a linear configuration and formed of two elongated parts axially aligned and adjustable with respect to each other for varying the length thereof, the parts including a left part with a longitudinal slot along the majority of its length and an aperture at its left end and an imperforate section at its right end with a projection therebetween, the parts including a right part with a longitudinal slot adapted to receive the projection and an aperture at its right end, and with indicia on the upper surface of the left part and right part;

a left component having an aperture at its front end and at its rear end and with an upper and lower surface with indicia on its upper surface;

a right component having an aperture at its forward end for alignment and coupling with the aperture at the right end of the first component and with an aperture at its rearward end for coupling with the aperture at the rear end of the left component, the upper surface of the rearward end of the right component being recessed for coupling with a mating recess in the lower surface of the rear end left component;

three coupling bolts with washers and wing nuts positionable through the aligned apertures at the ends of the components for securing them in a desired position;

an adjustment bolt, wing nut and washer positionable through the slot of the first part and an aligned aperture of the second part for adjusting the length of the two parts of the first component whereby a user may place his feet within the triangle created by the components in an orientation dictated by the selection of the club and the indicia on the front and left components.

2. A golfing aid for verifying a proper golfing stance comprising:

a front component positionable on the ground adjacent to golf ball to be hit in contact with the toes of the golfer's shoes and positioned between the feet of the player and the ball, the front component being in a linear configuration and formed of two elongated parts axially aligned and adjustable with respect to each other for varying the length thereof, the parts including a left part with a longitudinal slot along the majority of its length and an aperture at its left end and an imperforate section at its right end with a projection therebetween, the parts including a right part with a longitudinal slot adapted to receive the projection and an aperture at its right end;

a left component having an aperture at its front end and at its rear end and with an upper and lower surface;

a right component having an aperture at its forward end for alignment and coupling with the aperture at the right end of the first component and with an aperture at its rearward end for coupling with the aperture at the rear end of the left component, one surface of the rearward end of the right component being recessed for coupling with a mating recess in a mating surface of the rear end left component;

three coupling bolts with washers and wing nuts positionable through the aligned apertures at the ends of the components for securing them in a desired position;

an adjustment bolt, wing nut and washer positionable through the slot of the first part and an aligned aperture of the second part for adjusting the length of the two parts of the first component.

3. The device as set forth in claim 2 and further including indicia on the upper surface of at least one of the components.

* * * * *